US006736373B2

(12) United States Patent
Greaves

(10) Patent No.: US 6,736,373 B2
(45) Date of Patent: May 18, 2004

(54) CONNECTOR ASSEMBLY FOR HANDRAIL INSTALLATION

(75) Inventor: John Greaves, Hampshire (GB)

(73) Assignee: Kee Klamp Limited, Reading (GB)

( * ) Notice: Subject to any disclaimer, the term of this patent is extended or adjusted under 35 U.S.C. 154(b) by 0 days.

(21) Appl. No.: 10/147,901

(22) Filed: May 20, 2002

(65) Prior Publication Data

US 2002/0172545 A1 Nov. 21, 2002

(30) Foreign Application Priority Data

May 19, 2001 (GB) ..... 0112290

(51) Int. Cl.[7] ..... F16B 7/00

(52) U.S. Cl. ..... 256/65.16; 256/66; 403/158

(58) Field of Search ..... 256/67, 66, 65.08, 256/65.15, 65.16; 403/157, 158, 159, 161, 164

(56) References Cited

U.S. PATENT DOCUMENTS

| | | | | |
|---|---|---|---|---|
| 2,848,258 A | | 8/1958 | Mudd | |
| 5,964,452 A | * | 10/1999 | Summers | 256/65.08 |
| 6,213,318 B1 | * | 4/2001 | Walker | 403/157 X |

FOREIGN PATENT DOCUMENTS

| | | |
|---|---|---|
| DE | 36 03 717 A1 | 8/1987 |
| EP | 0 401 112 | 12/1990 |
| FR | 2 653 836 | 5/1991 |
| GB | 2 272 006 | 5/1994 |

* cited by examiner

*Primary Examiner*—John R. Cottingham
(74) *Attorney, Agent, or Firm*—Young & Thompson

(57) ABSTRACT

A connector assembly for a handrail installation comprises two connector components one of which locates within the bore of an end of a tubular member of the handrail installation and the other of which connects to a second member of the handrail installation, each connector component comprising a head portion and a location portion and the head portions of the two handrail connector components being provided with apertures to receive a retention means for holding the two connector components in interconnected relationship, said apertures and the retention means each having a major axis thereof extending substantially perpendicular to the longitudinal direction of said bore of the end of a tubular member of the handrail installation whereby, during construction of a handrail installation, the retention means may act as a pivot to allow the two connector components to pivot one relative to the other about an axis substantially perpendicular to said longitudinal direction, a first of said connector components providing a fixed location of the retention means relative to said first of the two components and a second of said components having an aperture which is of elongate form in a plane perpendicular to said major axis whereby, during construction of a handrail installation, the second member may be selectively positioned relative to the first member, said retention means being operable firmly to secure the two head portions relative to one another.

18 Claims, 4 Drawing Sheets

CONNECTOR ASSEMBLY FOR HANDRAIL INSTALLATION

BACKGROUND OF THE INVENTION

This invention relates to a connector assembly for a handrail installation, which term is used herein to include a balustrade installation, and which is adjustable for interconnection of two handrail components, such as two tubes, to lie in any of a range of positions relative to one another.

Connector devices for securing a tubular member to another tubular member or, for example, to support structure are used commonly in the construction of handrails and balustrades. The connector devices usually are required to provide a smooth surface in combination with the end of a tube to which they are connected and to interconnect with that tube in a tamper resistant manner.

One difficulty which arises in use of the known connector devices is that associated with the build up of tolerances in the handrail installation. In a handrail installation of the type having internally jointed components any mis-match of butted joints, such as between two tube ends or between a tube end and an end connector is visually undesirable. Much time and skill is needed in order accurately to cut tubes to length and create an installation in which all intended butt joints comprise components which are truly in abutment.

A further difficulty arising with use of conventional connector devices is that a considerable number of such connector devices are needed, and are required to be held in stock, in order to interconnect different size tubes and to allow interconnection of the tubes at any of a range of relative positions. Articulated type connection devices have been proposed but these generally suffer the disadvantage of being incompatible with providing a smooth and tamper resistant interconnection.

SUMMARY OF THE INVENTION

One object of the present invention is to provide an assembly for a handrail installation of a type which comprises internally connected members and exposed butt joints, and in which the aforedescribed assembly difficulties are mitigated or overcome. Another object of the present invention is to provide a connector assembly for use in forming a handrail installation.

In accordance with the one of its aspects the present invention provides a connector assembly for a handrail installation and comprising two connector components one of which is adapted to locate within the bore of an end of a tubular member of the handrail installation and the other of which is adapted for connection to a second member of the handrail installation, said two handrail components each comprising a head portion and a location portion and the head portions of the two handrail connector components being provided with apertures to receive a retention means for holding the two connector components in interconnected relationship, said apertures and the retention means having the major axis thereof extending substantially perpendicular to the longitudinal direction of said bore of the end of a tubular member of the handrail installation whereby, during construction of a handrail installation, the retention means may act as a pivot to allow the two connector components to pivot one relative to the other about an axis substantially perpendicular to said longitudinal direction, a first of said two connector components providing a fixed location of the retention means relative to said first of the two components and a second of said two components having an aperture of which is of elongate form in a plane perpendicular to said major axis whereby, during construction of a handrail installation, the second member may be selectively positioned relative to the first member, and said retention means being operable firmly to secure the two head portions relative to one another.

The invention envisages that preferably said first of said two connector components, being that which provides a fixed location for the retention means, is of a kind having a location portion adapted to locate within the bore of the end of a tubular member of a handrail installation.

The second of said two connector components may also have the location portion thereof adapted to located within the bore of the end of a tubular member, or it may, for example, have a location portion in the form of a mounting flange for attachment to the outer wall of a tubular member or other part of a handrail installation, or for attachment to support structure, such as a wall, floor or ground fixing position.

A connector component having a location portion of a kind adapted to locate within the bore of an end of a tubular member may comprise an annular shoulder between said location portion and the head portion. Said annular shoulder may act as an abutment against which an end of a tubular member may be abutted and secured relative thereto. A radially extending fastening means, such as a counter sunk screw, may be employed, to extend through the location portion of the connector component and engage with the wall of a tube end thereby axially to locate the tubular member and abutment of the connector component.

Said first of said two connector components may comprise a pair of lug formations spaced apart whereby the head portion of the other connector component may be located between the lug formations. The lug formations may each be apertured and the aperture of the other connector component may be alignable with said lug formation apertures. The head and location portions may be substantially hollow and the lug formations may lie at opposite sides of an opening which communicates to within the component.

One lug formation aperture may be screw threaded to receive and fixedly locate an end of a retention means such as a bolt. The aperture of the other of a pair of lug formations preferably is dimensioned such that a head portion of retention means is but relatively freely rotatable within that aperture and, optionally, radially supported. Preferably the length of the retention means is selected such that a head portion of the retention means can be brought into contact with the head portion of the other connector component by rotation of the bolt to screw it into the screw threaded aperture and thereby act on a side surface of the head portion of the second of the connector components to cause that head portion to bear firmly, non-pivotably against that lug formation of the first connector component formed with the screw threaded aperture.

The screw threaded aperture preferably is in the form of a blind hole.

Each of the lug formations of a first of the two connector components may be provided with substantially identical boss formations, one surrounding the blind ended hole of the apertured lug formation, and the other surrounding the through-bore aperture of the other lug formation and the through which the retention means, such as a screw threaded bolt, is insertable.

The elongate aperture in the lug formation in the second of said two connector components is selected preferably to have a width along the whole of its length which is less than the outer diameter of the head portion of a retention bolt, but a length which is greater than the diameter of said head portion. The length of the elongate aperture preferably is at least 50% greater than the width of the aperture. More preferably it has a length which is at least twice the width.

In the case of a second of two said connector components which has a location portion in the form of a mounting flange, said elongate aperture may be orientated with the length of the elongate aperture extending substantially perpendicular relative to the general plane of the mounting flange. Alternatively the aperture may be provided at an angle inclined relative to said perpendicular direction. In the case of a connector assembly for use in an inclined handrail installation for a stairway or ramp the elongate aperture may be inclined relative to said perpendicular direction, for example by an angle substantially equal to the general inclination of the stairway or ramp relative to vertical. Said angle preferably is selected such that in the assembled handrail installation the length of the elongate aperture is substantially parallel with the length of a tube connected to the other of said two connector components.

A mounting flange may comprise a non planar mounting face for attachment to a second member of a handrail installation. It may comprise a part cylindrical mounting surface, and said surface perfectly has a radius of curvature less than or equal to that of the outer surface of a circular section tube to which the mounting surface is to be secured.

The invention provides also a method of forming a handrail installation comprising use of a connector assembly in accordance with the present invention and wherein the facility for the two connector components to be secured relative to one another in a range of positions, determined by the distance by which the length of the elongate aperture exceeds the cross-section dimension of the retention means, is utilised to accommodate tolerance build-up and allow the installation to be assembled in a manner in which successive component parts, such as two abutting tubular members or the end of a tubular member and the shoulder of a connector component of the present invention, are in contact to provide a smooth finish to the installation.

BRIEF DESCRIPTION OF THE DRAWINGS

Embodiment of the present invention will now be described, by way of example only, with reference to the accompanying diagrammatic drawings in which.

DETAILED DESCRIPTION OF THE PREFERRED EMBODIMENTS

Figure 1:
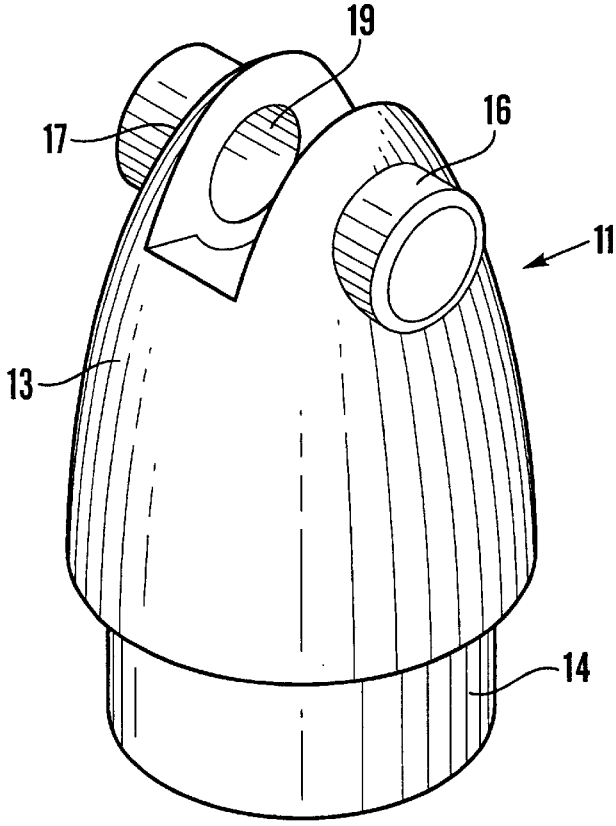
FIG. 1 is a perspective view of a tube end connector of a connector assembly of the present invention.
Figure 3:
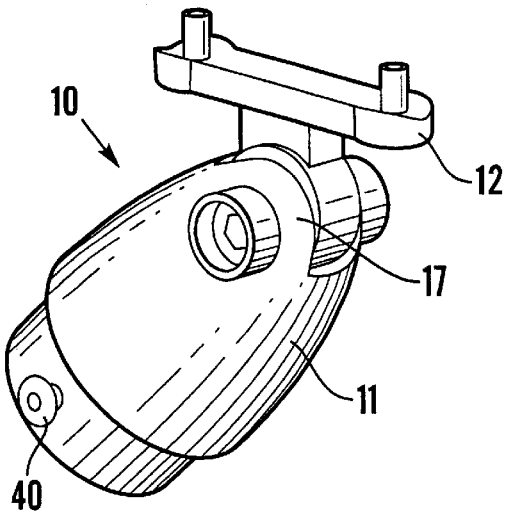
FIG. 3 shows a connector assembly of the connectors components of FIGS. 1 and 2.
Figure 2:
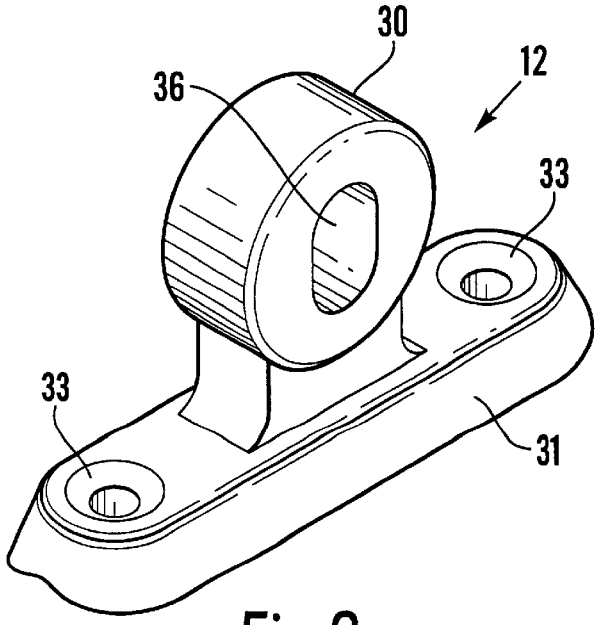
FIG. 2 is a perspective view of a tube side connector of a connector assembly of the present invention.
Figure 4:
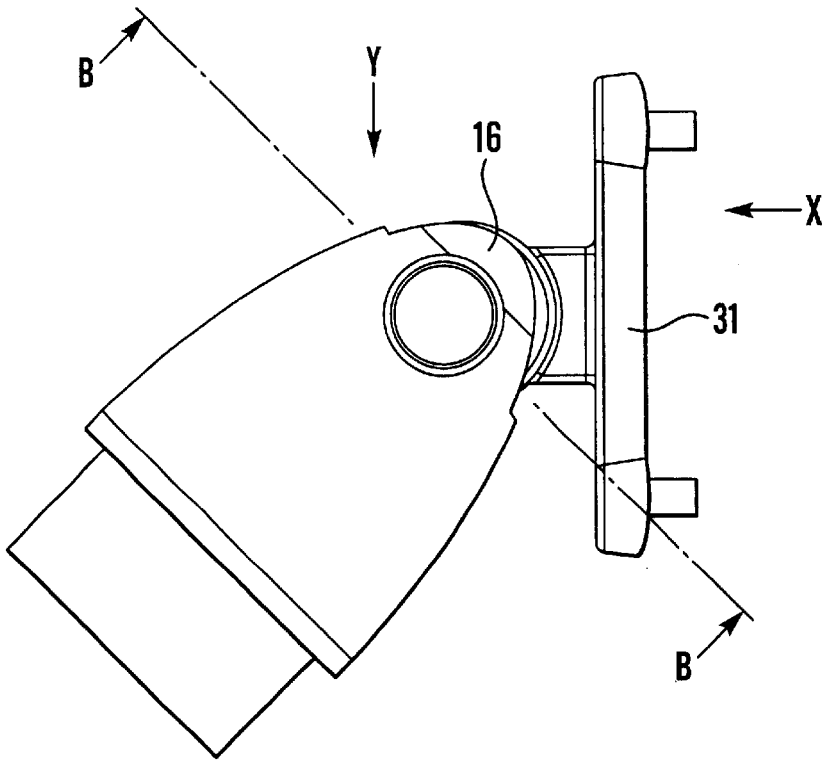
FIG. 4 is a side view of the assembly of FIG. 3.

FIGS. 1 and 2 show respectively a tube end connector component (11) and a tube side connector component (12) of the connector assembly (10) shown in FIG. 3.

The end connector (11) comprises a head portion (13) of generally circular cross-sectional shape and a tail portion (14) which depends from and is integral with the head portion. The tail portion (14) is in the form of a location sleeve for fitting within the end of a tube to which the connector (11) is to be secured. An annular abutment shoulder (15) is formed between the head and tail portions (13, 14) and has a radial dimension corresponding to the wall thickness of the tube into the end of which the tail portion is intended to be fitted.

The head portion (13) comprises two lug formations (16, 17) which are spaced apart and positioned symmetrically relative to the major, longitudinal axis of the connector (11).

The lug formation (16) is formed with an internally threaded blind ended hole (18). The other lug formation (17) comprises a smooth through-bore (19) aligned axially with the screw thread (18) and having a diameter which corresponds closely with but allows free rotation of the head portion (20) of a retention bolt (21) which is insertable through the through-bore (19). A part (22) of the length of the bolt adjacent to the head (20) is devoid of a screw thread formation.

The other connector component, the tube side wall connector (12), has a head portion (30) in the form of a single lug formation and is integral with a location flange (31).

Figure 7:
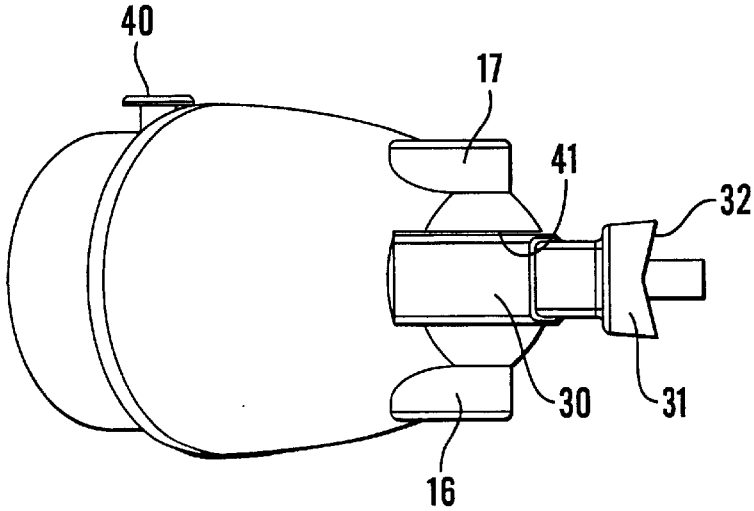
FIG. 7 is a view in the direction of arrow "Y" of FIG. 4.

The location flange (31) is of an elongate shape and has a mounting face (32) opposite that side of the flange from which the head portion (30) extends. The mounting face (32) is of a "V" shape in cross-section (see FIG. 7) whereby, when positioned against the surface of a circular section tube, it engages the tube along two spaced lines of contact. The location flange (31) is formed with two apertures (33) and provided with counter sunk fixing screws (34) for attachment to the side of a tube to which a connection is to be established.

The lug (30) of the head portion has a thickness slightly less than the spacing of confronting surfaces of the lug portions (16, 17) of the tube end connector (11). It can therefore be located between those lug portions, and is formed with an elongate aperture (36) through which the retention bolt (21) extends in the assembled condition of the two connectors (11, 12).

The slot (36) extends lengthwise in a direction substantially perpendicular to the length of the location flange (31). The width of the slot, as considered in a direction parallel with the length of the location flange, is slightly greater than the diameter of the section (22) of the bolt adjacent the bolt head (20), but less than the outer diameter of the bolt head (20). The axial length of the elongate slot (36) in this embodiment is approximately twice the width of the slot.

Figure 5:
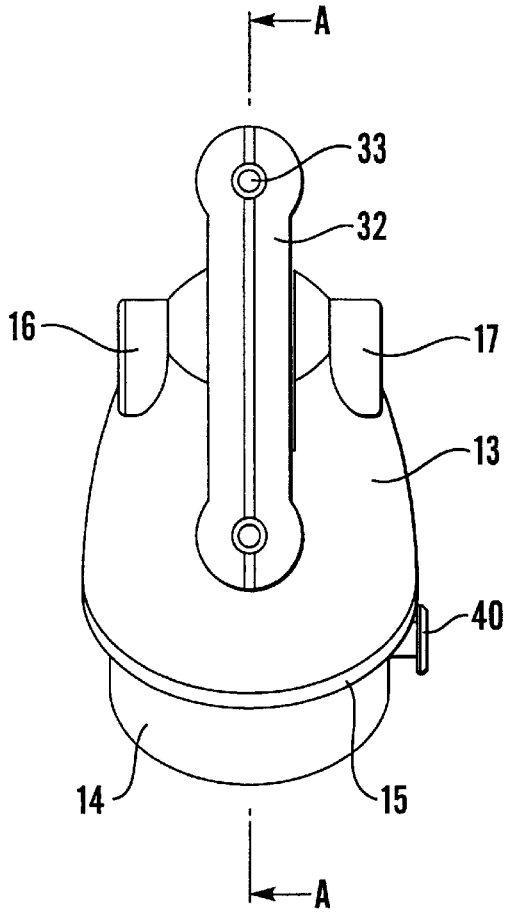
FIG. 5 is a view in a direction of arrow "X" of FIG. 4.
Figure 6:
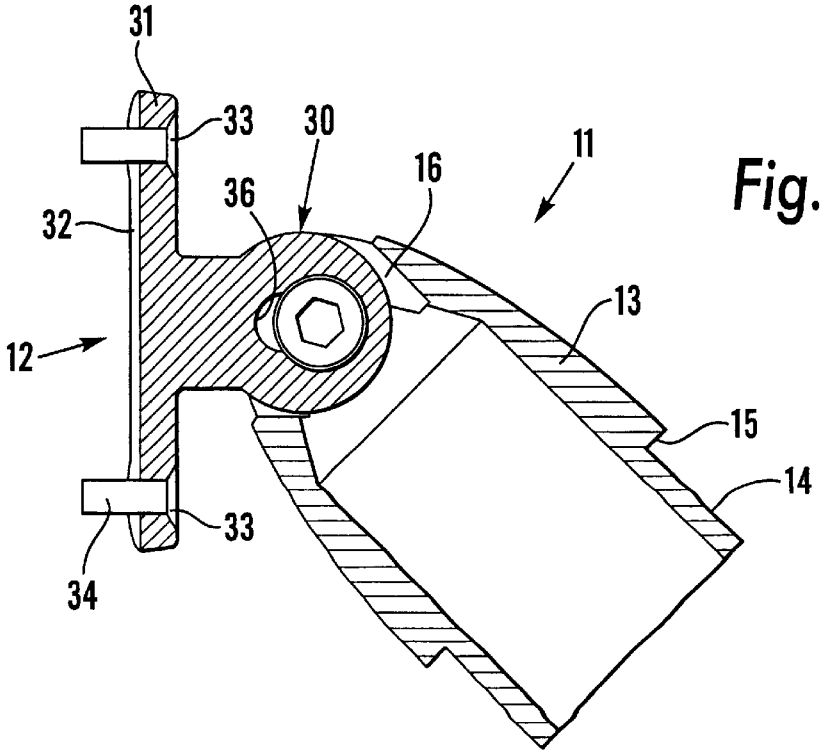
FIG. 6 is a section on the line "A—A" of FIG. 5.
Figure 8:
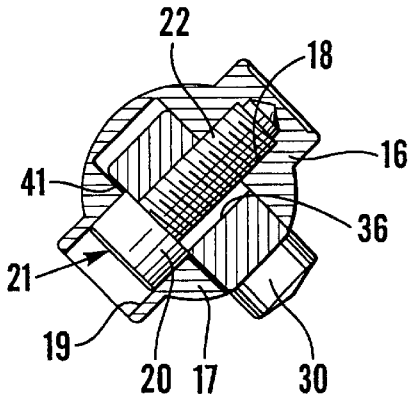
FIG. 8 is a section on the line "B—B" of FIG. 4.

In use of the connector assembly (10) to form an interconnection between the end of a tube and the outer wall of another tube, the tail portion (14) of the connector (11) is inserted in the end of one of the tubes, and retained therein in known manner by means of a counter sunk screw arranged to extend through an opening in the end of the tube wall, to engage screw threadedly with a tapped hole formed in the sleeve (14). Alternatively a rivet, such as the rivet (40) of FIGS. 5 and 7 may be employed. The location flange (31) of the other connector component (12) is secured by means of the aforedescribed counter sunk fixing screw (34), or alternatively by means of rivets, to the side wall of a second tube. Either before or subsequent to fitting one or each of the connector components (11, 12) to a respective tube, a retention bolt (20) is inserted through the opening (19) of lug formation (17), to extend through the aligned slot (36) of the component (12) and screw threadedly engage in the thread (18) of lug formation (16). Subsequent to correct positioning of the two interconnected tubes relative to one another the bolt (20) is tightened in the screw thread (18) to cause the head of the bolt to bear against a confronting side face (41) of the lug (30) and cause the other face to bear firmly against the confronting surface of the lug (16), thereby to prevent free relative movement of the two connector components (11, 12).

Figure 9:
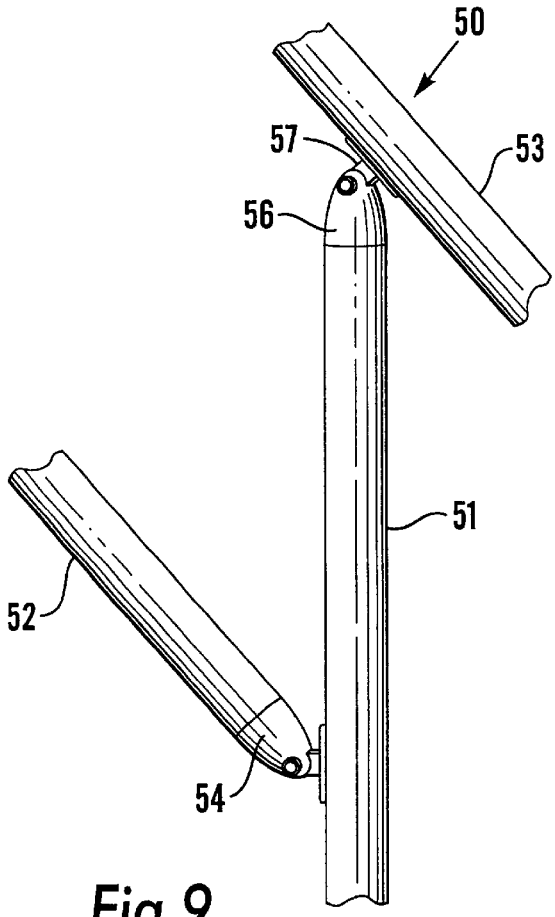
FIG. 9 shows part of a handrail assembly comprising connector assemblies of the present invention.

FIG. 9 shows a handrail assembly (50) of the present invention and comprising a vertical post (51), and intermediate rail (52) and an upper handrail (53). The post (51) is connected to each of the inclined rails (52, 53) by means of the aforedescribed connector assembly (10). By virtue of the provision of an elongate slot in the tube side wall connector (12) small tolerance errors in the length of the tube (52) are accommodated by on site positioning of the two connector components (11, 12) relative to one another such that it is possible to preserve a smooth, gap free surface between the end of the tube (52) and the inserted connector component (54). Similarly, any error in the vertical height of the tube (51), either due to tolerance effects in the length to which the tube has been cut, or the position of a mounting point, can be accommodated by on site movement of the tube end connector (56) relative to the other connector component (57) such that a smooth surface effect is nevertheless achieved between the inserted connector component (56) and the upper end of the tube (51).

Figure 10:
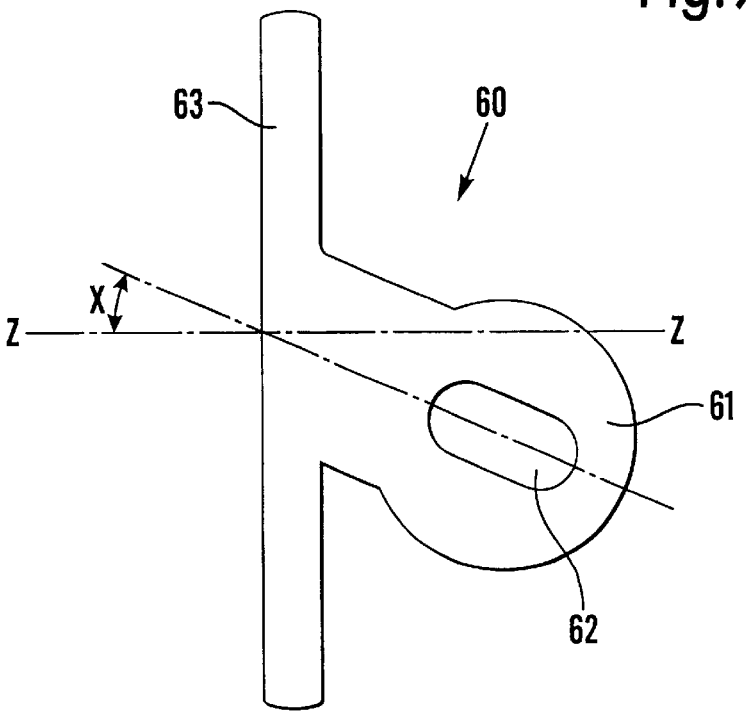
FIG. 10 is a side view of another tube side connector.

FIG. 10 shows another tube side wall connector (60) suitable for use with the aforedescribed tube end connector (11) to form the handrail assembly (50) of FIG. 9.

The connector (60) comprises a head portion (62) and a location flange (63). The connector (60) corresponds substantially with that shown in FIG. 2 except that instead of the aperture extending lengthwise in a direction Z—Z perpendicular to the length of the location flange, it is orientated at an angle x relative to the perpendicular direction Z—Z. The angle x is selected to correspond with or closely approximate to the angle of inclination (relative to the horizontal) of the inclined rails (52, 53) of FIG. 9 such that the length direction of the aperture (62) is aligned substantially with the tube (51, 52) secured to that end connector to which the connector (62) is attached.

What is claimed is:

1. A connector assembly for a handrail installation comprising:

two connector components, a first of the two connector components adapted to locate within the bore of an end of a first tubular member of the handrail installation, and a second of the two connector components adapted for connection to a second member of the handrail installation, said two connector components each comprising a head portion and a location portion, the head portions of the two handrail connector components being provided with apertures to receive a retention means for holding the two connector components in interconnected relationship, said apertures and the retention means each having a major axis thereof extending substantially perpendicular to the longitudinal direction of said bore of the end of a tubular member of the handrail installation whereby, during construction of a handrail installation, the retention means may act as a pivot to allow the two connector components to pivot one relative to the other about an axis substantially perpendicular to said longitudinal direction, the first of said two connector components providing a fixed location of the retention means relative to said first of the two connector components, and the second of said two connector components having an elongate aperture elongated in a plane perpendicular to said major axis whereby, during construction of a handrail installation, the second member may be selectively positioned relative to the first member, and said retention means being operable firmly to secure the two head portions relative to one another, wherein said first of said two connector components comprises a pair of lug formations spaced apart wherein the head portion of the second connector component may be located between the lug formations, each of said lug formations is apertured and the aperture of the second connector component is alignable with said lug formation apertures, one lug formation aperture is screw threaded to receive and fixedly locate an end of the retention means, the aperture of the other of the pair of lug formations is dimensioned such that a head portion of the retention means is relatively freely rotatable within that aperture, and the head portion of the retention means may be brought into contact with the head portion of the other connector component by rotation of the bolt to screw it into the screw threaded aperture and thereby act on a side surface of the head portion of the second of the connector components to cause that head portion to bear firmly, non-pivotably against that lug formation of the first connector component formed with the screw threaded aperture.

2. A connector assembly according to claim 1, wherein the location portion of the second of said two connector components comprises a mounting flange.

3. A connector assembly according to claim 2, wherein the mounting flange comprises a non-planar mounting face for attachment to a second member of a handrail installation.

4. A connector assembly according to claim 1, wherein the location portion of at least one of said two connector components comprises a location sleeve.

5. A connector assembly according to claim 4, wherein said location portion comprises an annular shoulder between said location portion and the head portion, said annular shoulder providing an abutment against which an end of a tubular member may be abutted and secured relative thereto.

6. A connector assembly according to claim 4, wherein a radially extending fastening means is employed to extend through the location portion of the connector component and engage with the wall of a tube end thereby axially to locate the tubular member and abutment of the connector component.

7. A connector assembly according to claim 1, wherein the head and location portions of said first connector component are substantially hollow and the lug formations lie at opposite sides of an opening which communicates to within the component.

8. A connector assembly according to claim 1, wherein the screw threaded aperture is a blind hole.

9. A connector assembly according to claim 1, wherein the aperture of the other of a pair of lug formations is dimensioned such that a head portion of retention means is radially supported.

10. A connector assembly according to claim 1, wherein the elongate aperture in the lug formation in the second of said two connector components has a width along the whole of its length which is less than the outer diameter of the head portion of a retention bolt, but a length which is greater than the diameter of said head portion.

11. A connector assembly according to claim 10, wherein the length of the elongate aperture is at least 50% greater than the width of the aperture.

12. A connector assembly according to claim 11, wherein said length is at least twice the width.

13. A connector assembly according to claim 1, wherein the second of said two connector components has a location portion in the form of a mounting flange and said elongate aperture is orientated with the length of the elongate aperture extending substantially perpendicular relative to the general plane of the mounting flange.

14. A connector assembly according to claim 1, wherein the second of said two connector components has a location portion in the form of a mounting flange and said elongate aperture is orientated with the length of the elongate aperture extending at an angle inclined relative to a direction perpendicular to the general plane of the mounting flange.

15. A handrail installation for a stairway or ramp of an inclined type and comprising a connector assembly according to claim 1, the elongate aperture of the second of said two connector components having the length direction thereof substantially parallel with the length of a tube connected to the other of said two connector components.

16. A method of forming a handrail installation comprising use of a connector assembly in accordance with claim 1 and wherein the facility for the two connector components to be secured relative to one another in a range of positions, determined by the distance by which the length of the elongate aperture exceeds the cross-section dimension of the retention means, is utilised to accommodate tolerance build-up and allow the installation to be assembled in a manner in which successive component parts, such as two abutting tubular members or the end of a tubular member and the shoulder of a connector component of the present invention, are in contact to provide a smooth finish to the installation.

17. A connector assembly for a handrail installation, comprising:

two connector components, a first of the two connector components adapted to locate within the bore of an end of a first tubular member of the handrail installation, and a second of the two connector components adapted for connection to a second member of the handrail installation, said two connector components each comprising a head portion and a location portion, the head portions of the two handrail connector components being provided with apertures to receive a retention means for holding the two connector components in interconnected relationship, said apertures and the retention means each having a major axis thereof extending substantially perpendicular to the longitudinal direction of said bore of the end of a tubular member of the handrail installation whereby, during construction of a handrail installation, the retention means may act as a pivot to allow the two connector components to pivot one relative to the other about an axis substantially perpendicular to said longitudinal direction, the first of said two connector components providing a fixed location of the retention means relative to said first of the two connector components, the second of said two connector components having an elongate aperture elongated in a plane perpendicular to said major axis whereby, during construction of a handrail installation, the second member may be selectively positioned relative to the first member, and said retention means being operable firmly to secure the two head portions relative to one another, wherein, said first of said two connector components comprises a pair of lug formations spaced apart wherein the head portion of the second connector component may be located between the lug formations, each of said lug formations is apertured and the aperture of the second connector component is alignable with said lug formation apertures, one lug formation aperture is screw threaded to receive and fixedly locate an end of the retention means, the aperture of the other of the pair of lug formations is dimensioned such that a head portion of the retention means is relatively freely rotatable within that aperture, the head portion of the retention means may be brought into contact with the head portion of the other connector component by rotation of the bolt to screw it into the screw threaded aperture and thereby act on a side surface of the head portion of the second of the connector components to cause that head portion to bear firmly, non-pivotably against that lug formation of the first connector component formed with the screw threaded aperture, and the head and location portions of said first connector component are substantially hollow and the lug formations lie at opposite sides of an opening which communicates to within the first connector component.

18. A connector assembly for a handrail installation, comprising:

two connector components, a first of the two connector components adapted to locate within the bore of an end of a first tubular member of the handrail installation, and a second of the two connector components adapted for connection to a second member of the handrail installation, said two connector components each comprising a head portion and a location portion, the head portions of the two handrail connector components being provided with apertures to receive a retention means for holding the two connector components in interconnected relationship, said apertures and the retention means each having a major axis thereof extending substantially perpendicular to the longitudinal direction of said bore of the end of a tubular member of the handrail installation whereby, during construction of a handrail installation, the retention means may act as a pivot to allow the two connector components to pivot one relative to the other about an axis substantially perpendicular to said longitudinal direction, the first of said two connector components providing a fixed location of the retention means relative to said first of the two connector components, the second of said two connector components having an elongate aperture elongated in a plane perpendicular to said major axis whereby, during construction of a handrail installation, the second member may be selectively positioned relative to the first member, and said retention means being operable firmly to secure the two head portions relative to one another, wherein, said first of said two connector components comprises a pair of lug formations spaced apart wherein the head portion of the second connector component may be located between the lug formations, each of said lug formations is apertured and the aperture of the second connector component is alignable with said lug formation apertures, one lug formation aperture is screw threaded to receive and fixedly locate an end of the retention means, the aperture of the other of the pair of lug formations is dimensioned such that a head portion of the retention means is relatively freely rotatable within that aperture, the head portion of the retention means may be brought into contact with the head portion of the other connector component by rotation of the bolt to screw it into the screw threaded aperture and thereby act on a side surface of the head portion of the second of the connector components to cause that head portion to bear firmly, non-pivotably against that lug formation of the first connector component formed with the screw threaded aperture, the location portion of at least one of said two connector components comprises a location sleeve, and said location portion comprises an annular shoulder between said location portion and the head portion, said annular shoulder providing an abutment against which an end of a tubular member may be abutted and secured relative thereto.

* * * * *